US008875731B2

(12) United States Patent
Larsen

(10) Patent No.: US 8,875,731 B2
(45) Date of Patent: Nov. 4, 2014

(54) AUTOMATIC WATER LEVELER

(76) Inventor: David Larsen, Mesa, AZ (US)

( * ) Notice: Subject to any disclaimer, the term of this patent is extended or adjusted under 35 U.S.C. 154(b) by 482 days.

(21) Appl. No.: 12/566,648

(22) Filed: Sep. 24, 2009

(65) Prior Publication Data

US 2010/0071123 A1 Mar. 25, 2010

Related U.S. Application Data

(60) Provisional application No. 61/099,669, filed on Sep. 24, 2008.

(51) Int. Cl.
*F16K 31/18* (2006.01)
*E04H 4/12* (2006.01)

(52) U.S. Cl.
CPC ..... *E04H 4/12* (2013.01)
USPC ..... 137/428; 137/135; 137/434; 137/443; 137/528; 4/508

(58) Field of Classification Search
USPC ..... 137/135, 205.5, 426, 428, 429, 434, 137/442, 443, 449, 528; 4/508
See application file for complete search history.

(56) References Cited

U.S. PATENT DOCUMENTS 1,800,378 A * 4/1931 Everson ..... 210/123
2,739,939 A * 3/1956 Leslie ..... 210/127
2,809,752 A * 10/1957 Leslie ..... 210/127
3,739,405 A * 6/1973 Schmidt ..... 4/508
3,908,206 A * 9/1975 Grewing ..... 4/508
4,373,220 A * 2/1983 Selsted ..... 4/508
4,607,399 A * 8/1986 Yovanofski ..... 4/508
4,686,718 A * 8/1987 Kinkead et al. ..... 4/508
4,724,552 A * 2/1988 Kinkead et al. ..... 4/508
4,836,239 A * 6/1989 Kinkead ..... 137/413
4,901,754 A * 2/1990 Sable et al. ..... 137/433
5,154,205 A * 10/1992 Langill ..... 137/393
5,358,003 A * 10/1994 Langill ..... 137/406
5,365,617 A * 11/1994 Tarr ..... 4/508
5,367,723 A * 11/1994 Pleva et al. ..... 4/508
5,459,886 A * 10/1995 Payne et al. ..... 4/508
5,790,991 A * 8/1998 Johnson ..... 4/508
6,012,481 A * 1/2000 Lenart ..... 137/426
6,080,324 A * 6/2000 Pleva ..... 210/791
7,003,817 B1 * 2/2006 Pansini ..... 4/508
7,311,118 B2 * 12/2007 Doutt ..... 137/539.5
2008/0124237 A1 * 5/2008 Viken ..... 418/219

* cited by examiner

*Primary Examiner* — Craig Schneider
*Assistant Examiner* — Matthew W Jellett
(74) *Attorney, Agent, or Firm* — Wright Law Group, PLLC; Mark F. Wright

(57) ABSTRACT

An apparatus for automatically maintaining the water level of a body of water, such as a pool, is described herein. The present invention comprises a float body contained within a float housing chamber and selectively coupled to a float valve, a ball check valve employed as a means for isolating the pressurized water in the circulation system of a body of water from the water in the float chamber and, after pump operation has ceased, allowing the passage of supply water from the float chamber of the apparatus of the circulation system of a body of water. Flexible conduits or tubing may be provided for ease of installation. Furthermore, the present invention is intended to be conveniently located near the equipment of the circulation system for the body of water.

11 Claims, 5 Drawing Sheets

AUTOMATIC WATER LEVELER

RELATED APPLICATIONS

This non-provisional patent application claims priority based on the filing date of U.S. Provisional Patent Application Ser. No. 61/099,669, which application was filed on Sep. 24, 2008, and which application is incorporated herein by reference.

BACKGROUND OF THE INVENTION

1. Technical Field

The present invention relates generally to the field of in-ground bodies of water and more specifically relates to an apparatus for maintaining the desired level of water in a swimming pool, spa, or the like.

2. Background Art

Automatic water levelers of varying size, functionality, and complexity have been devised to maintain the water level of a spa, pool, or other similar types of in-ground bodies of water. Generally, automatic water levelers can be divided into two groups; water levelers that are positioned at the side of the body of water and in close proximity to the body of water, and pump-side water levelers. Pump-side water levelers typically employ electrical or mechanical means to monitor the water level of the body of water and, being in communication with the water leveler, maintain the water level of the body of water. The automatic water levelers that employ mechanical means to maintain the water level of a pool or spa most often use a float, or the like, in conjunction with a smaller separate body of water, wherein the water level of the separate body of water is in equilibrium with the water level of the pool, thereby maintaining the water level of the pool.

The benefits of using a mechanical pump-side automatic water leveler versus an electric water leveler or a pool-side water leveler, are well-known to those skilled in the art. The procedure for installing an automatic water leveler in a pre-existing pool deck or wall is often time consuming and costly; furthermore, the end result is, more often than not, aesthetically unpleasing.

In general, there is an additional cost and complexity associated with the installation of an electric automatic water leveler when compared to that of a mechanical automatic water leveler. Existing electric automatic water levelers, in most cases, require a separate electrical line or power source to supply the necessary power to operate the water leveler. Additionally, there may be one or more control lines to be installed. In those cases where the water leveler is located some distance from the other pool equipment such as the pump and filter, the electrical and/or control lines will typically be run from the pump location to the water leveler. The greater the distance, the greater the expense that will be incurred in the running of electrical and/or control lines to and from the water leveler.

The conventional mechanical pump-side water leveler is typically comprised of four or more primary assemblies or components; namely: a float assembly, a water canister, a non-return valve, and a water supply valve. The non-return valve is designed to prevent the flow of water into or out of the water canister during pump operation,. Most often, these water-leveler subassemblies or components are situated in two or more locations within the pool system, thus complicating the installation process and increasing the expense. Ideally, a water leveler should require minimum installation and site preparation and, yet, would operate reliably and be manufactured at a modest expense.

BRIEF SUMMARY OF THE INVENTION

The present invention holds significant improvements when compared with the abovementioned water levelers. As an example, the present invention consists of one, easy to install, main assembly. The main assembly is comprised of a non-return valve, a float valve assembly, and a float assembly, all of which are enclosed within a water canister. The only connections that remain to be made prior to water leveler operation are those of the water supply to a float valve assembly and the water canister outlet to a water circulation pipe.

The design of the ball check valve represents another significant improvement when compared to check valves incorporated in the design of conventional water levelers. According to the most preferred embodiments of the present invention, the non-return valve comprises a valve housing, a ball, a ball seat and guide, and a particulate screen. The check valve is closed during pump operation to prevent the flow of water into the water-leveler canister, and the potential overfilling of the water-leveler canister. While the pool pump is off, the ball check valve is open, allowing supply water to pass through the ball check valve and fill the pool with a relatively small amount of resistance. To ensure that the ball is withdrawn from the ball seat immediately after the pool pump has shut off, the elastic material, of which the water leveler outlet tube is composed, returns to its undisturbed shape and size, thereby resulting in a momentary suction on the outlet of the water leveler that aids in extracting the ball from the ball seat.

Another distinctive characteristic of the present invention relates to the design of the float assembly. In contrast to most conventional water levelers, the float assembly of the present invention is easily adjustable, thereby providing for quick and easy adjustment of the water level in the swimming pool. In at least one preferred embodiment of the present invention, the float-rod spring clip is the component of the float assembly that facilitates the height adjustment of the float. This is readily accomplished by pressing both ends of the float-rod spring clip towards each other and positioning the float-rod spring clip such that the water level of the pool will be maintained at the desired level. In an alternative preferred embodiment of the present invention, a series of "spacer" rings are placed on the rod that is connected to the float assembly. By adding or subtracting spacer rings to the rod, the desired level of the water in the body of water can be calculated for automatic leveling purposes.

In addition to the abovementioned feature, the float assembly incorporates two other qualities of a notable nature. First, on the opposite end of the float valve armature is a float rod retainer. The float rod retainer may be unthreaded from the float rod, thereby allowing the entire float assembly to become uncoupled from the float valve armature and subsequently extracted from the float chamber. Second, the float assembly employs two counterweights. The counterweights ensure that the float valve closes and opens as the water rises and falls, respectively. Additionally, the counterweights provide further stability for the float assembly and maintain the float rod in a vertical position, which is essential to accurately maintaining the water level of the pool.

As a means of facilitating the installation of the water leveler, the supply-water tube may be effortlessly connected and disconnected from the water leveler assembly via a combination of a push-lock fittings and a tube composed of nylon, polyvinyl, or the like; or by way of threaded male and female fittings. Additionally, in accordance with at least one preferred embodiments of the present invention, the water leveler inlet and outlet are arranged to minimize the overall width of the water leveler, and consequently, minimize the diameter of hole that, in many cases, must be made in order to accommodate the automatic water leveler of the present invention.

BRIEF DESCRIPTION OF THE DRAWINGS

The preferred embodiments of the present invention will hereinafter be described in conjunction with the appended drawings, wherein like designations denote like elements, and.

DETAILED DESCRIPTION

Figure 1:
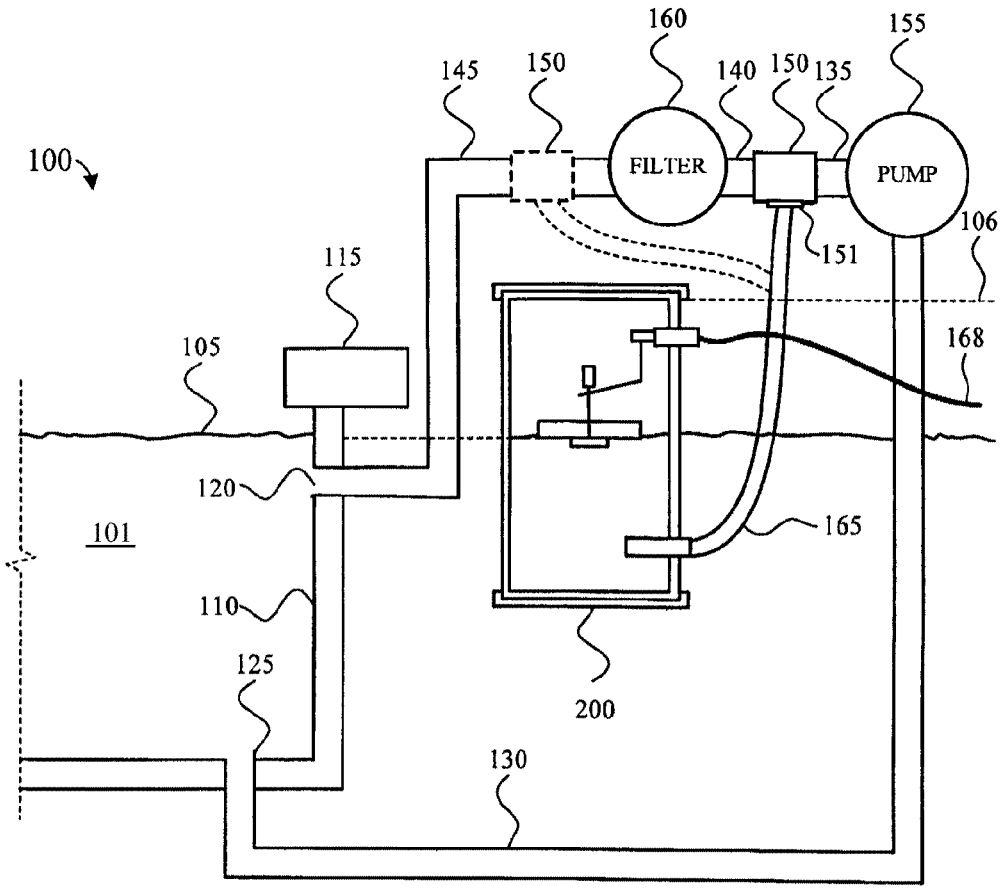
FIG. 1 is a sectional view of a schematic representation for an in-ground swimming pool system and an automatic water leveler in accordance with a preferred embodiment of the present invention.

Referring now to FIG. 1, a schematic diagram of an in-ground swimming pool system 100 coupled to an automatic water leveler 200 in accordance with a preferred embodiment of the present invention is depicted. As shown in FIG. 1, pool system 100 comprises a pool structure 110, filled with water 101 wherein the top surface of water 101 is at water level 105; a pool deck 115; at least one pool outlet 125; at least one pool inlet 120; a plurality of water circulations pipes 130, 135, 140, and 145; a pump 155; and a filter 160.

With the notable exception of automatic water leveler 200 and its associated piping elements, pool system 100 is a fairly standard installation and pool systems of this type are well known to those skilled in the art. The various components of pool system 100 are used to provide a circulating water flow within pool structure 110. As shown in FIG. 1, automatic water leveler 200 is configured to be installable at several different locations on pool system 100. Automatic water leveler 200 may be communicatively coupled to the system between pump 155 and filter 160 or after filter 160. This flexibility is due to the unique design of automatic water leveler 200 and existing water leveling systems do not offer this flexibility.

Figure 1A:
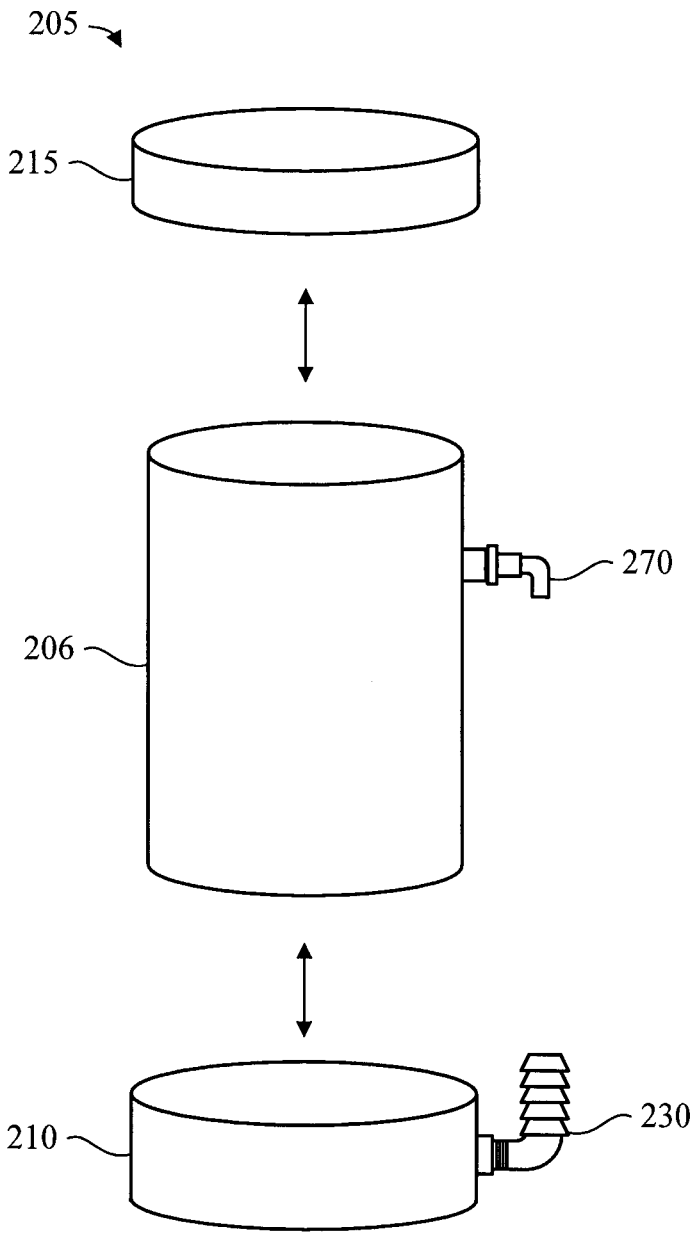
FIG. 1A is an exploded view of the exterior float assembly housing for the major components of an automatic water leveler in accordance with a preferred embodiment of the present invention.

Referring now to FIG. 1A, a float chamber housing assembly 205 in accordance with a preferred exemplary embodiment of the present invention is comprised of a float chamber body 206, an end cap 210, and a float chamber cover 215. End cap 210 and float chamber cover 215 cover the bottom and top portions of the float chamber body 206, respectively. According to one of the most preferred embodiments of the present invention, end cap 210 is secured to the bottom of the float chamber body 206 by means of a water proof glue or adhesive, such as PVC glue or the like. Float chamber cover 215 is loosely secured to the float chamber body 205 in order to provide easy access to the float chamber 207. In addition, a female thread 90° elbow fitting 270 is provided for coupling float chamber body 205 to an existing water supply or system.

Figure 2:
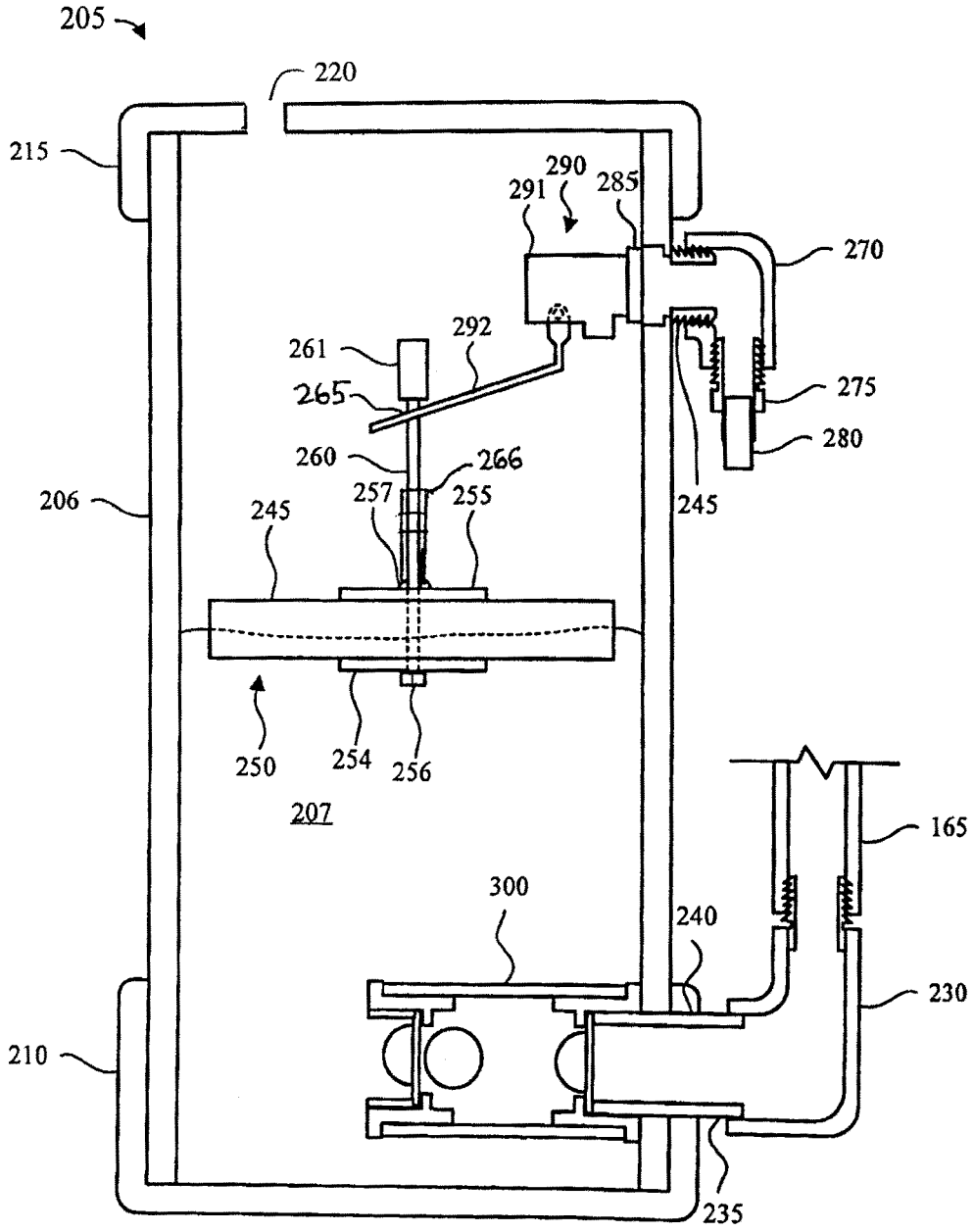
FIG. 2 is a section view of an automatic water leveler in accordance with a preferred embodiment of the present invention.

Referring now to FIG. 2, an automatic water leveler assembly 200 in accordance with a preferred embodiment of the present invention comprises four major subassemblies, namely: a float chamber housing assembly 205, a float valve assembly 290, a float assembly 250, and a ball check valve assembly 300. The float valve assembly 290, the float assembly 250, and the ball check valve assembly 300 are contained within, and/or attached to, the float chamber body 206. Aside from the four subassemblies, the present invention comprises additional components used to connect water leveler assembly 200 to the water supply and the pool circulation system.

The float chamber housing assembly 205 is comprised of a float chamber body 206, an end cap 210, and a float chamber cover 215. In most applications the float chamber housing assembly 205 is situated partially below ground level 106. The float chamber body 206 has two apertures that are aligned vertically at either end of the float chamber body 206. The float chamber housing inlet aperture 285 permits the mounting of the float valve assembly 290 to the float chamber body 206; and likewise, the float chamber housing outlet aperture 240 permits the mounting of the ball check valve assembly 300 to the float chamber body 206 and serves as an outlet port for the water as the water fills the pool.

Another aperture, float chamber vent orifice 220, is a feature of the float chamber cover 215. Float chamber vent orifice 220 permits the influx or efflux of ambient air, thereby enabling the absolute static air pressure inside float chamber housing assembly 205 to be in equilibrium with the absolute static air pressure acting perpendicular to the surface of the pool water. Float chamber vent orifice 220 ensures that the water level 105 found in float chamber 207 is at the same water level 105 of the pool.

End cap 210 and float chamber cover 215 cover the bottom and top portions of the float chamber body 206, respectively. According to one of the most preferred embodiments of the present invention, end cap 210 is secured to the bottom of the float chamber body 206 by means of a water proof glue or adhesive, such as PVC glue or the like. Float chamber cover 215 is loosely secured to the float chamber body 205 in order to provide easy access to the float chamber 207.

Float valve armature 292 is coupled to float valve 291 via an internally mounted pin and is selectively coupled to float assembly 250. As float assembly alters its vertical position, float valve armature 292 rotates about a pin mounted with float valve 291. In essence, float valve armature 292 behaves as a lever arm, wherein the force applied to stop the flow of water is several times greater than the force applied to float valve armature 292 by spring clip 265. Alternatively, a series of spacer rings 266 may be added to float rod 260 for purposes of adjusting the position of the float assembly 250 within float body chamber 206. The inner diameter of each spacer ring 266 is large enough to fit over the outer diameter of float rod 260. By adding or removing one or more spacer rings 266, the position where float valve 291 is activated can be easily altered and adjusted.

Figure 4:
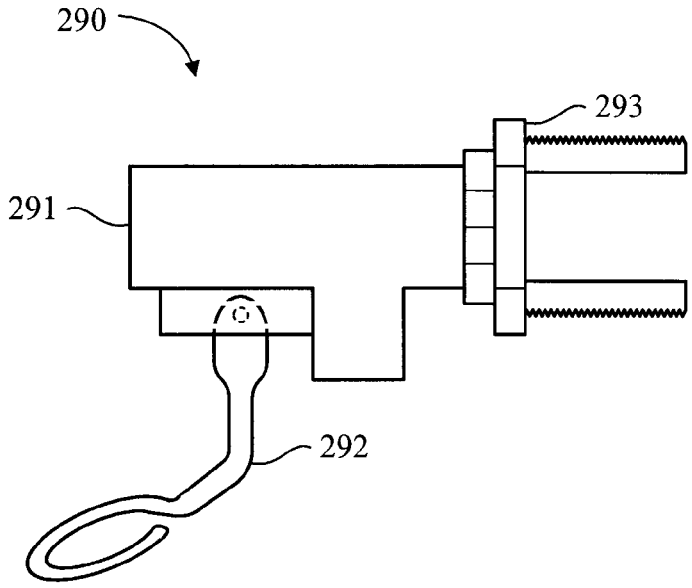
FIG. 4 is a perspective view of a float valve assembly for a automatic water leveler in accordance with a preferred embodiment of the present invention.

As shown in FIG. 4, float valve armature 292 completely constrains the side-to-side motion of float assembly 250, with respect to float valve 291.

In the most preferred embodiments of the present invention, float valve 291 is secured to the float chamber body 206 by way of a male-by-female threaded coupler 293. To secure the male-by-female threaded coupler to water leveler assembly 200, the male portion of the male-by-female threaded coupler is threaded tightly into the adjoining float chamber body 206 and female thread 90° elbow fitting 270. Float valve 291 is, in turn, threaded tightly into the female portion of the male-by-female threaded coupler. As a means to ensure that no water enter or escapes from float chamber housing inlet aperture 285, an adhesive is applied to the outer threads of the male-by-female threaded coupler and subsequently threaded into its final assembly configuration.

Float assembly 250 is comprised of a float 245; an upper and lower float counterweights 255 and 254, respectively; a float rod 260 secured to float 245 and lower float counterweight 254 with a bolt 256; a float rod retainer 261; and a spring clip 265 or spacer rings 266. According to the preferred embodiments of the present invention, upper float counterweight 255 is joined to float rod 260 by a fillet weld 257. Float 245 is affixed to float rod 260, by compressing float 245 between upper and lower float counterweights 255 and 254, respectively. This compression is achieved by threading bolt 256 onto the threaded portion of float rod 260 and against lower float counterweight 254 while upper float counterweight 255 remains affixed to float rod 260 by means of weld 257.

Float assembly 250 is supported by water 101 and float valve armature 292. When the water level 105 is sufficiently low enough, so as to support less than the total weight of float assembly 250, float valve armature 292 applies a force to float rod retainer 261 that is sufficient to support the remainder of the weight of float assembly 250. Additionally, when the abovementioned conditions prevail, float valve 291 is throttled from the closed positioned to an opened position, thereby allowing water 101 to fill the pool. When the water level 105 is high enough, so as to meet or exceed the water level 105 of the pool, spring clip 265 applies an upward force on float valve armature 291 sufficient to block the flow of water 101 through float valve 291. Spring clip 265 maintains its vertical position on float rod 260 by exerting a normal force, and consequently a frictional force, on float rod 260 as a result of the elastic deformation impinged upon spring clip 265. To adjust the water level 105 of the pool, the ends of spring clip 265 are brought closer together so as to overcome the spring force and subsequently adjust the position of spring clip 265 corresponding to the desired water level 105 of the pool.

Figure 3:
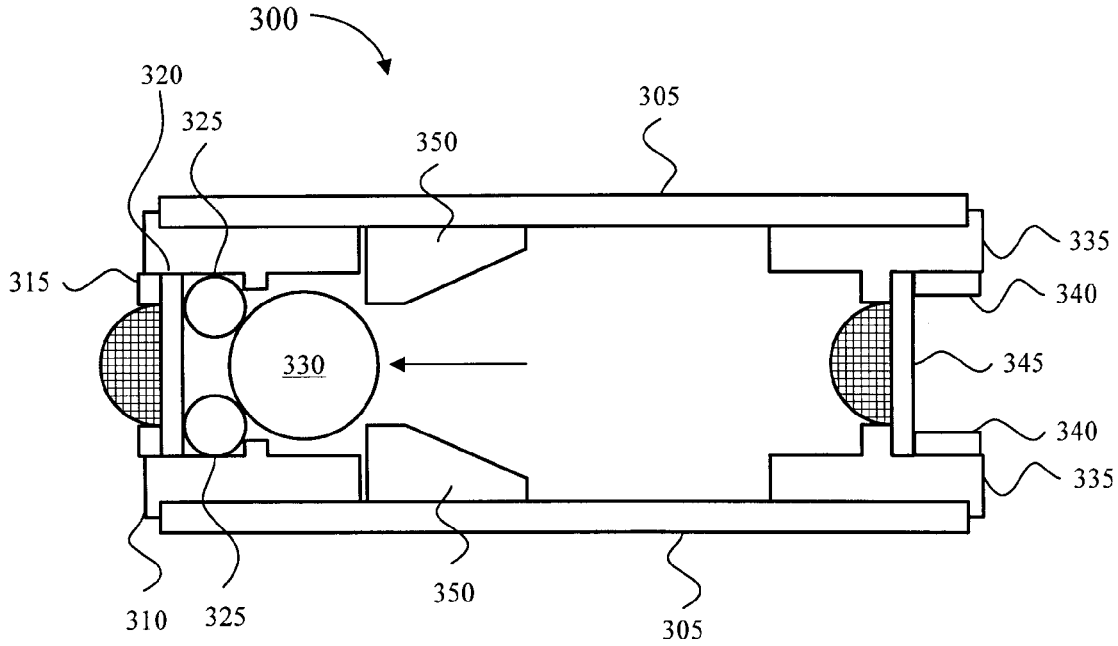
FIG. 3 is a sectional view of a horizontal ball check valve in accordance with a preferred embodiment of the present invention.

Referring now to FIG. 3, ball check valve assembly 300 is comprised of a ball check valve housing 305; ball seat and screen retainer fittings 310 and 335, respectively; ball seat and screen retainer rings 315 and 340, respectively; particulate screens 320 and 345; ball seat 325; and ball 330. During normal operation of pump 155, the pressurized water 101 causes ball 330 to seat against ball seat 325, thus obstructing the flow of water 101 through ball check valve assembly 300. Ball guides 350 are optional elements and may be included as a feature of ball seat retainer fitting 310 to facilitate the motion of ball 330 to ball seat 325.

Referring now to FIG. 1 and FIG. 3, and according to one of the preferred embodiments of the present invention, as shown in FIG. 1, water leveler outlet tube 165 is manufactured from a rubber-like material. When pump 155 ceases operation, the elastic material, of which water leveler outlet tube 165 is composed, returns to its undisturbed shape and size, thereby resulting in a region of low pressure (i.e. suction), relative to the pressure of water 101 inside float chamber 207, near the outlet of the water leveler assembly 200, that aids in extracting ball 330 from ball seat 325. From thence, the water level 105 inside the float chamber 207 equalizes with the water level 105 of the pool. While water 101 is flowing through ball check valve assembly 300 to pool inlet 120 and pool outlet 125, particulate screen 345 prevents ball 330 from obstructing the flow of water 101 through ball check valve assembly 300.

According to the most preferred embodiments of the present invention, ball seat retainer fitting 310, ball seat retainer ring 315, screen retainer fitting 335, retainer ring 340 are secured to the adjacent polyvinyl chloride (PVC) substrate by means of pipe adhesive. Particulate screens 320 and 345 and ball seat 325 are held in place by ball seat retainer ring 315 and retainer ring 340.

According to the most preferred embodiments of the present invention, ball 330 is composed of a polymer material whose density is near that of water. By making ball 330 from a material whose density is near that of water, the buoyancy force acting on ball 330 is overcome easier than if a ball 330, of density much different than that of water, was employed. Other key characteristics of ball 330 include the smoothness and roundness of ball 330. To ensure that ball 330 forms a tight seal against ball seat 325, ball 330 should be round and have a smooth surface. Additionally, ball seat 325 is composed of a rubber-like material so as to minimize the effect that ball 330 out-of-roundness or roughness may have on the seal created by ball 330 and ball seat 325.

The preferred method of installing water leveler assembly 200 as a component of pool system 100 involves several actions. First, a site is chosen, preferably near the pool filter 160 and pool pump 155, where the water leveler assembly 200 will be situated. Then the site is prepared to accommodate water leveler assembly 200. This may include excavating soil from the area or placing mounting brackets on an adjacent structure and digging a hole in the ground for the installation of water level assembly 200. Next, tee fitting 150 is connected to second water circulation pipe 135 and third water circulation pipe 140. Water leveler outlet tube 165 is connected to barbed fitting 151 and the opposite end of water leveler outlet tube 165 is connected barbed fitting 230. The water level can also be determined by the use of a piece of rubber hosing and siphoning some water from the body of water into another container and determining the desired level of water by allowing the level of the water in the other container to stablize.

The installer positions water leveler assembly 200 in horizontal space so that the central portion of float chamber body 206 is approximately at the same level as the desired water level for the relevant body of water. The installer makes note of the desired water level and aligns a water level mark on the outer surface of float chamber body 206 to coincide with the predetermined water level 105. Water leveler assembly 200 is then secured in place by a method known to one skilled in the art. Water leveler outlet tube 165 is connected to barbed fitting 225 and water supply tube 280 is connected from its water supply source to push-lock fitting 275. Finally, the installer tests water leveler assembly 200 to ensure proper operation.

Referring now to FIG. 4, float valve assembly 290 is comprised of float valve 291, float valve armature 292, and male-by-female threaded coupler. Float valve 291 is a standard float valve used in many swimming pool applications. Among other benefits, float valve 291 affords reliable operation, ease of installation, and exhibits the desired throttling action which minimizes float valve 291 cycling, thereby reducing water hammer.

Figure 5:
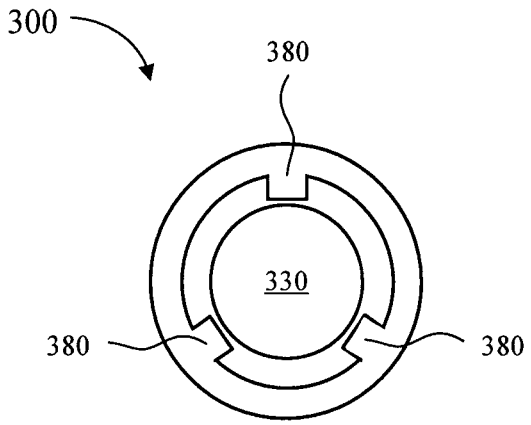
FIG. 5 is a cross-sectional view of housing for a check valve assembly in accordance with an alternative preferred embodiment of the present invention.

Referring now to FIG. 5, a cross sectional view of a portion of the interior of the body of ball check valve 300 is depicted. In this embodiment of the present invention, a series of guides or ridges 380 are employed to ensure that ball 330 does not begin "oscillating" in the interior of the body of ball check valve 300. In certain environments, it ball 330 may oscillate instead of seating firmly into position, thereby preventing ball check valve 300 from performing its intended function.

From the foregoing description, it should be appreciated that a water leveler assembly 200 preferred embodiment and a method for producing and installing said water leveler assembly 200 are provided and present significant benefits that would be apparent to one skilled in the art. Furthermore, it should be appreciated that a vast number of variations in the embodiments exist. Lastly, it should be appreciated that these embodiments are preferred exemplary embodiments only, and are not intended to limit the scope, applicability, or configuration of the invention in any way. Rather, the foregoing detailed description provides those skilled in the art with a convenient framework for implementing a preferred exemplary embodiment of the invention. It being understood that various changes may be made in the function and arrangement of elements described in the exemplary preferred embodiment without departing from the spirit and scope of the invention as set forth in the appended claims.

The invention claimed is:

1. An apparatus for automatically maintaining a predetermined water level in a body of water, wherein the apparatus is communicatively coupled to a circulation system for the body of water by a pipe, said apparatus comprising:

a float valve assembly employed as a means to restrict the flow of supply water into a float chamber of said apparatus, wherein the float valve assembly includes a float valve with an armature to actuate said float valve;

a ball check valve contained within the float chamber, the float chamber being configured to isolate the pressurized water in the circulation system of the body of water from the water in the float chamber of the apparatus and, after pump operation has ceased, to allow the passage of supply water from the float chamber of the apparatus to the circulation system of the body of water;

an elastic outlet conduit connected to the apparatus, wherein the elastic outlet conduit is employed as a means of aiding in extraction of a ball within the ball check valve from a ball seat of the ball check valve, wherein the ball comprises a polymide material of a density near that of water, and wherein said extraction is caused by a momentary suction at an outlet of the float chamber as said elastic outlet conduit returns to its undisturbed shape after pump operation has ceased;

a float assembly fully residing within said float chamber and removably coupled to said float valve assembly, the float assembly comprising:

(a) a float rod that couples a float to said armature, wherein said float rod allows vertical movement of said float assembly depending on a level of water in said float chamber, wherein said float rod has an upper end and a lower end, wherein said lower end of said float rod is secured to an upper counterweight, and said float is secured to said upper counterweight;

(b) a float rod retainer threaded to said upper end of said float rod, wherein said float rod retainer can be unthreaded from said float rod to allow said float assembly to be uncoupled from said float valve assembly and removed from said float chamber;

(c) at least one selectively removable spacer ring for adjusting a maximum height of the float with respect to the float valve assembly, wherein the at least one selectively removable spacer ring is placed over said float rod between said float rod retainer and said upper counterweight to directly engage a bottom portion of said armature and change a vertical position where said float assembly activates said armature of said float valve assembly; and (d) a push-lock fitting and at least one flexible supply line employed as a means of connecting said apparatus to a water source.

2. The apparatus of claim 1 further comprising a bolt secured to said lower end of said float rod to attach a lower counterweight and said float against said upper counterweight.

3. The apparatus of claim 1 wherein the apparatus is connected to the circulation system by being positioned on a water line between a pump and a filter.

4. The apparatus of claim 1 further comprising at least one barbed pipe fitting configured to secure the outlet conduit of the apparatus to the circulation system of the body of water.

5. A method of installing an apparatus for automatically maintaining a water level of a body of water comprising the steps of:

(a) selecting a site near a pump of a circulation system of the body of water;

(b) excavating a hole at, or otherwise preparing, a selected site near the body of water, the hole having a diameter sufficient as to accommodate the apparatus for automatically maintaining the water level of the body of water and sufficient depth so as to approximately align a water level mark on an exterior surface of said apparatus with the water level of the body of water;

(c) connecting an outlet tube connected to the apparatus to the circulation system for the body of water and connecting a supply-water tube to the apparatus and a pressurized water source;

(d) connecting said apparatus to a water source using a push-lock fitting and at least one flexible supply line; and (e) cycling the apparatus sufficiently to ensure proper operation, wherein the apparatus comprises:

a float valve assembly employed as a means to restrict the flow of supply water into a float chamber of said apparatus, wherein said float valve assembly includes a float valve with an armature to actuate said float valve;

a float assembly completely contained within said float chamber and removably coupled to said float valve assembly, said float assembly comprising:

1) a float rod that couples a float to said armature, wherein said float rod allows vertical movement of said float assembly depending on a level of water in said float chamber, wherein said float rod has an upper end and a lower end, wherein said lower end of said float rod is secured to an upper counterweight, and said float is secured to said upper counterweight;

2) a float rod retainer threaded to said upper end of said float rod, wherein said float rod retainer can be unthreaded from said float rod to allow said float assembly to be uncoupled from said float valve assembly and removed from said float chamber; and 3) at least one selectively removable spacer ring for adjusting a maximum height of the float with respect to the float valve assembly, wherein said at least one selectively removable spacer ring is placed over said float rod, and wherein in a non-engaged position the armature is not supported by the at least one spacer ring, and during an engaged position said at least one spacer ring is movable by the float to directly engage a bottom portion of said armature and change a vertical position of the float spacer ring and armature when said float assembly activates said armature of said float valve assembly.

6. The method of claim 5 wherein the outlet tube of step (c) is connected to at least one barbed pipe or conduit and a water circulation system for a body of water.

7. The method of claim 5 wherein the supply-water tube of step (c) is connected to the push-lock fitting attached to said apparatus and to a compression fitting attached to the pressurized water source.

8. The method of installing an apparatus for automatically maintaining the water level of a body of water of claim 5 wherein the outlet tube of step (c) is connected to at least one barbed fittings attached to the apparatus and a water circulation system for a body of water and the supply-water tube of step (c) is connected to the push-lock fitting attached to the apparatus and a compression type fitting attached to the pressurized water source.

9. An apparatus comprising:

a float chamber housing assembly;

a float valve assembly completely contained within said float chamber housing assembly, said float valve assembly comprising a float valve with an armature to actuate the float valve;

a ball check valve assembly completely contained within said float chamber housing assembly;

an elastic outlet conduit connected to the apparatus, wherein the elastic outlet conduit is employed as a means of aiding in extraction of a ball within the ball check valve from a ball seat of the ball check valve, wherein the ball comprises a polymide material of a density near that of water, and wherein said extraction is caused by a momentary suction at an outlet of the float chamber as said elastic outlet conduit returns to its undisturbed shape after pump operation has ceased;

a float assembly completely contained within said float chamber housing assembly, said float assembly comprising:

1) a float rod that couples a float to said armature, wherein said float rod allows vertical movement of said float assembly depending on a level of water in said float chamber, wherein said float rod has an upper end and a lower end, wherein said lower end of said float rod is secured to an upper counterweight, and said float is secured to said upper counterweight;

2) a float rod retainer threaded to said upper end of said float rod, wherein said float rod retainer can be unthreaded from said float rod to allow said float assembly to be uncoupled from said float valve assembly and removed from said float chamber housing assembly; and 1) at least one selectively removable spacer ring for adjusting a maximum height of the float with respect to the float valve assembly, wherein said at least one selectively removable spacer ring is placed over said float rod, and wherein in a non-engaged position the armature is not supported by the at least one spacer ring, and during an engaged position said at least one spacer ring is movable by the float to directly engage a bottom portion of said armature and change a vertical position of the float spacer ring and armature when said float assembly activates said armature of said float valve assembly.

10. The apparatus of claim 9 wherein said ball check valve assembly further comprises:

a ball check valve housing;

at least one ball seat;

at least one screen retainer fitting;

at least one particulate screen; and at least one pair of ball guides.

11. The apparatus of claim 9 wherein said float chamber housing assembly is configured to be communicatively coupled to a water supply system between a pump and a filter that is connected to a piping system that supplies the water supply system or, alternatively, between the filter and the piping that supplies the water supply system.

* * * * *